US008240997B2

(12) United States Patent
Shirahama et al.

(10) Patent No.: US 8,240,997 B2
(45) Date of Patent: Aug. 14, 2012

(54) CENTRIFUGAL IMPELLER AND CENTRIFUGAL BLOWER USING THE CENTRIFUGAL IMPELLER

(75) Inventors: Seiji Shirahama, Aichi (JP); Hitoshi Yoshikawa, Gifu (JP)

(73) Assignee: Panasonic Corporation, Osaka (JP)

( * ) Notice: Subject to any disclaimer, the term of this patent is extended or adjusted under 35 U.S.C. 154(b) by 670 days.

(21) Appl. No.: 12/517,833

(22) PCT Filed: Dec. 7, 2007

(86) PCT No.: PCT/JP2007/073639

§ 371 (c)(1),
(2), (4) Date: Jun. 5, 2009

(87) PCT Pub. No.: WO2008/072558

PCT Pub. Date: Jun. 19, 2008

(65) Prior Publication Data

US 2010/0322762 A1 Dec. 23, 2010

(30) Foreign Application Priority Data

Dec. 14, 2006 (JP) ..... 2006-336844
Jul. 2, 2007 (JP) ..... 2007-173683

(51) Int. Cl.
*F04D 29/28* (2006.01)

(52) U.S. Cl. ..... 416/178; 416/187

(58) Field of Classification Search ..... 416/187, 416/178, 186 R, 189, 179, 182, 185, 188, 416/144; 417/423.8
See application file for complete search history.

(56) References Cited

U.S. PATENT DOCUMENTS

| | | | | |
|---|---|---|---|---|
| 4,659,951 | A * | 4/1987 | Angi et al. | 310/62 |
| 6,224,335 | B1 * | 5/2001 | Parisi et al. | 416/186 R |
| 6,604,906 | B2 * | 8/2003 | Ozeki et al. | 416/186 R |
| 6,964,555 | B2 * | 11/2005 | Ochiai et al. | 416/186 R |
| 2004/0131465 | A1 | 7/2004 | Ochiai et al. | |
| 2005/0169757 | A1 * | 8/2005 | Chen et al. | 416/179 |
| 2006/0239815 | A1 | 10/2006 | Hanai | |

FOREIGN PATENT DOCUMENTS

| | | |
|---|---|---|
| CN | 1752604 | 3/2006 |
| JP | 32-2415 Y1 | 4/1957 |
| JP | 54-89506 U | 6/1979 |
| JP | 55-92100 U | 6/1980 |

(Continued)

OTHER PUBLICATIONS

International Search Report of PCT Application No. PCT/JP2007/073639 dated Jan 15, 2008.

*Primary Examiner* — Richard Edgar
(74) *Attorney, Agent, or Firm* — Panasonic Patent Center; Dhiren Odedra; Kerry Culpepper

(57) ABSTRACT

Centrifugal impeller (14) of centrifugal air blower (1) has main plate (15); a plurality of blades (18); ring-shaped plate (20); and a cylindrical wall (22). The blades (18) are circumferentially disposed on the side of the outer periphery of front side (17) of main plate (15). Ring-shaped plate (20) is attached to tip sections (19) of blades (18). Cylindrical wall (22) is disposed on the back side (21) of the main plate (15) so as to be concentric therewith. The structure above provides centrifugal impeller (14) and centrifugal air blower (1) with improved air-blow efficiency and noise-reduced operations.

23 Claims, 14 Drawing Sheets

FOREIGN PATENT DOCUMENTS

| | | | |
|---|---|---|---|
| JP | 59-35699 | U | 3/1984 |
| JP | 63-128291 | U | 8/1988 |
| JP | 1-170797 | A | 7/1989 |
| JP | 4-1621 | U | 1/1992 |
| JP | 5-231392 | A | 9/1993 |
| JP | 2002-161896 | A | 6/2002 |
| JP | 2004-204756 | A | 7/2004 |
| JP | 3629690 | B | 3/2005 |
| JP | 2005-121310 | A | 5/2005 |
| JP | 2006-090297 | | 4/2006 |
| JP | 2006-90297 | A | 4/2006 |
| JP | 2006-299965 | A | 11/2006 |

* cited by examiner

CENTRIFUGAL IMPELLER AND CENTRIFUGAL BLOWER USING THE CENTRIFUGAL IMPELLER

TECHNICAL FIELD

The present invention relates to a centrifugal impeller used for a ventilating fan and an air-conditioning device, and also relates to a centrifugal air blower using the centrifugal impeller.

BACKGROUND ART

In recent years, there has been an increasing need for a downsized structure of a ventilating fan and an air-conditioning device so as to be suitable for a limited installation space in a living or non-living environment. At the same time, there has been a growing demand for the devices to have improved air-blow efficiency and noise-reduced structure.

Hereinafter will be described conventional structures of a centrifugal impeller and a centrifugal air blower with reference to FIG. 14. Centrifugal air blower 101 of FIG. 14 has casing 107; centrifugal impeller 112 with a multi-blade structure; and electric motor 113. Casing 107 has air-intake plate 103; back plate 104 that faces air-intake plate 103; and side wall 106. Casing 107 is formed so that air-intake plate 103 and back plate 104 hold side wall 106 therebetween. Air-intake plate 103 has bell-mouthed air inlet 102. Formed into a spiral, side wall 106 has air outlet 105. Accommodated in casing 107, centrifugal impeller 112 has ring-shaped side plate 108; main plate 110; and a plurality of blades 111. Main plate 110 has draw part 109 formed into a cone that protrudes toward side plate 108. Centrifugal impeller 112 has a structure where blades 111 are held between side plate 108 and main plate 110. Besides, centrifugal impeller 112 is connected to rotary shaft 114 of electric motor 113. Electric motor 113 is fixed to back plate 104. Such structured centrifugal air blower 101 is disclosed, for example, in Japanese Unexamined Patent Application Publication No. 3629690 (hereinafter, referred to Patent document 1).

In centrifugal air blower 101 with the aforementioned structure, a driving force fed from motor 113 to rotary shaft 114 rotates centrifugal impeller 112. The rotation of centrifugal impeller 112 allows intake air 115 to pass through air inlet 102 and flow into blades 111, increasing pressure. Intake air 115 flows out of blades 111 and passes casing 107. While passing casing 107, intake air 115 gradually changes the increased pressure from dynamic form to static form, and is discharged from air outlet 105 to the outside. In the process above, flow 116, which comes from blades 111 and passes casing 107, maintains high pressure. Therefore, flow 116 from blades 111 partly flows into the space between main plate 110 and back plate 104, generating backflow 117. If backflow 117 stagnantly stays around there, air-blow efficiency of centrifugal air blower 101 can be lowered. To prevent this, ventilation holes 118 are disposed in main plate 110. Having ventilation holes 118 allows backflow 117 to go back into blades 111, producing circulation flow 119. This prevents against the degradation of the air-blow efficiency. In addition, ventilation holes 118 suppress the intake air 115 from hitting draw part 109 and flowing into blades 111. Further, by virtue of ventilation holes 118, intake air 115 and circulation flow 119 are led to electric motor 113, by which electric motor 113 is cooled.

Here will be described another structure of conventional centrifugal air blower 101 with reference to FIG. 15. Centrifugal air blower 101 of FIG. 15 has a structure where a part of back plate 104 of casing 107 located outside centrifugal impeller 112 is expanded in the direction of the rotary shaft. Besides, the degree of the expansion with respect to the rotating direction gradually increases toward air outlet 105. Such structured centrifugal air blower 101 is disclosed, for example, in Japanese Unexamined Patent Application Publication No. 2690005 (hereinafter, referred to Patent document 2).

The aforementioned structure of centrifugal air blower 101 allows the flow fed from centrifugal impeller 112 to have a wide channel. Besides, the channel gradually increases toward air outlet 105, allowing centrifugal air blower 101 to have an improved air-blow efficiency and noise-reduced structure.

However, the conventional structures of centrifugal impeller 112 and centrifugal air blower 101 disclosed in Patent document 1 have some problems. That is, flow 116 fed from blades 111 partly goes as backflow 117 between main plate 110 and back plate 104. As described above, the conventional structure has a ventilation hole so as to form circulation flow 119 to prevent a stagnant state of the backflow. At that time, however, flow 116 flown out from the periphery of main plate 110 collides with backflow 117. The collision of flows hinders blades 111 disposed adjacent to main plate 110 in exerting their functions appropriately, which invites degradation of blower efficiency of centrifugal air blower 101. Besides, the collision of flow 116 and backflow 117 allows circulation flow 119 to be flown back, in a turbulent state, into blades 111. This also contributes to degradation of blower efficiency of centrifugal air blower 101. Further, the collision of flow 116 from the periphery of main plate 110 and backflow 117 generates turbulence noise.

Responding to demands for size reduction of centrifugal impeller 112, manufacturers have tried a structure where a part of electric motor 113 is disposed at cone-shaped draw part 109; the arrangement depends on the size of motor 113 and centrifugal impeller 112, and at the same time, draw part 109 has a limitation in its height. The constraints above have been an obstacle to size reduction of centrifugal air blower 101.

On the other hand, according to conventional centrifugal air blower 101 introduced in Patent document 2, back plate 104 has an intricate structure, specifically, casing 107 is partly formed into a spiral. This allows centrifugal air blower 101 to have a complex structure; accordingly, to have low productivity and high production cost.

Patent document 1; Japanese Unexamined Patent Application Publication No. 3629690

Patent document 2; Japanese Unexamined Patent Application Publication No. 2690005

SUMMARY OF THE INVENTION

The centrifugal impeller and a centrifugal air blower of the present invention offer high efficiency of air blow and low-noise operations. At the same time, the reduced-size and simplified structure contribute to cost-reduced production.

The centrifugal impeller of the present invention has a disc-shaped main plate; a plurality of blades; a ring-shaped plate; and a cylindrical wall. The blades are circumferentially disposed on the side of the outer periphery of the front side of the main plate. The ring-shaped plate is attached to tip sections of the blades. The cylindrical wall is disposed on the back side of the main plate so as to be concentric therewith. The structure above provides a centrifugal impeller with improved air-blow efficiency and low-noise operations.

The centrifugal air blower of the present invention has a centrifugal impeller; an electric motor having a rotary shaft fixed to the centrifugal impeller; and a casing. The centrifugal impeller has a disc-shaped main plate; a plurality of blades; a ring-shaped plate; and a cylindrical wall. The blades are circumferentially disposed on the side of the outer periphery of the front side of the main plate. The ring-shaped plate is attached to tip sections of the blades. The cylindrical wall is disposed on the back side of the main plate so as to be concentric therewith. The main plate is fixed to the rotary shaft in the casing. The casing has an air-intake plate with a bell-mouthed air inlet; a back plate that faces the air-intake plate; a spiral-shaped side wall; and an air outlet. The structure above provides a centrifugal air blower with improved air-blow efficiency and low-noise operations.

REFERENCE MARKS IN THE DRAWINGS

Figure 1A:
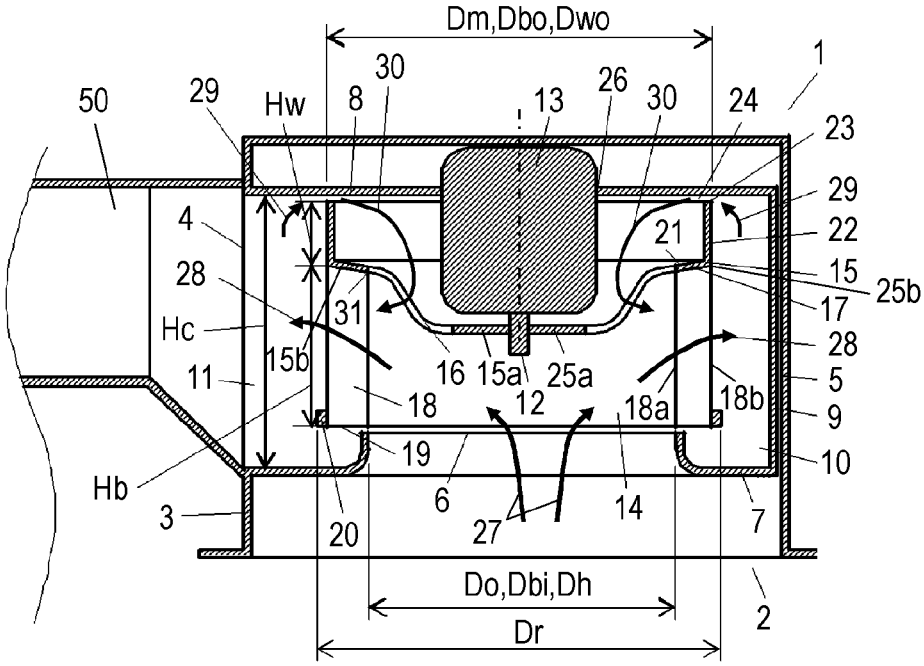
FIG. 1A is a side sectional view showing a centrifugal impeller and a centrifugal air blower in accordance with a first exemplary embodiment of the present invention.

1 centrifugal air blower
2 bottom
3 side
4 duct-connection opening
5 outer wall
6 air inlet
7 air-intake plate
8 back plate
9 side wall
10 casing
11 air outlet
12 rotary shaft
13 electric motor
14 centrifugal impeller
15 main plate
15*a* main-plate projection
15*b* joint section
16 ventilation hole
17 front side
18 blades
18*a* blade inner-periphery
18*b* blade outer-periphery
19 tip sections
20 ring-shaped plate
21 back side
22 cylindrical wall
23 edge
24 space
25*a* center
25*b* outer periphery
26 motor-fixing hole
27 intake air
28, 28*a* flow
29 backflow
30 circulation flow
31 outer periphery edge
32 outer cylindrical wall
33 inner cylindrical wall
34 drain hole
35 sound-absorbing material
36 cylindrical space
37 lid
38 small hole
39 perforated board
40 screw boss
41 screw
42 tongue
43 main part
44 helical plate
45 back-plate projection
46 swirl flow

DETAILED DESCRIPTION OF THE PREFERRED EMBODIMENTS

The exemplary embodiments of the present invention are described hereinafter with reference to the accompanying drawings.

First Exemplary Embodiment

Figure 1B:
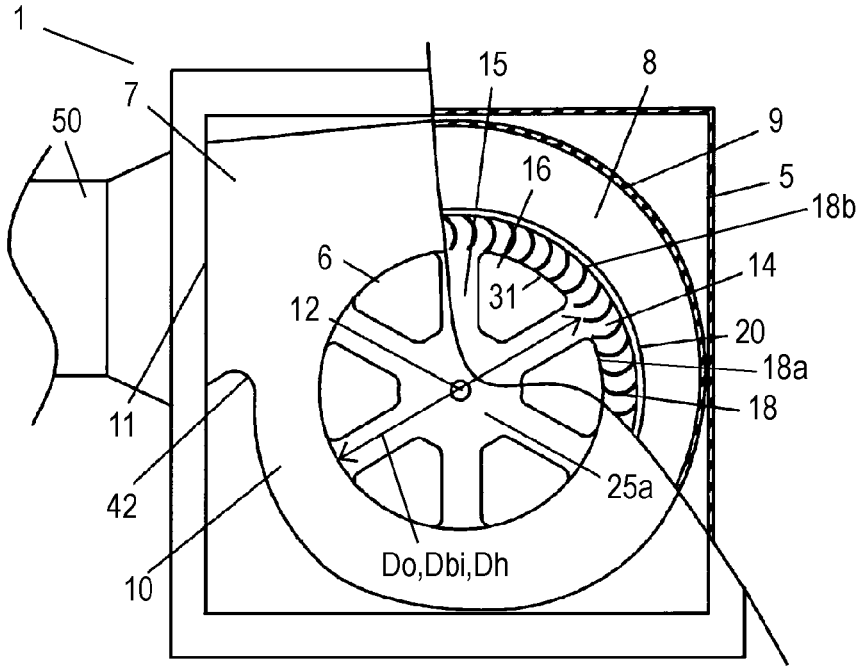
FIG. 1B is a partial sectional front view showing the centrifugal impeller and the centrifugal air blower shown in FIG. 1A.
Figure 2:
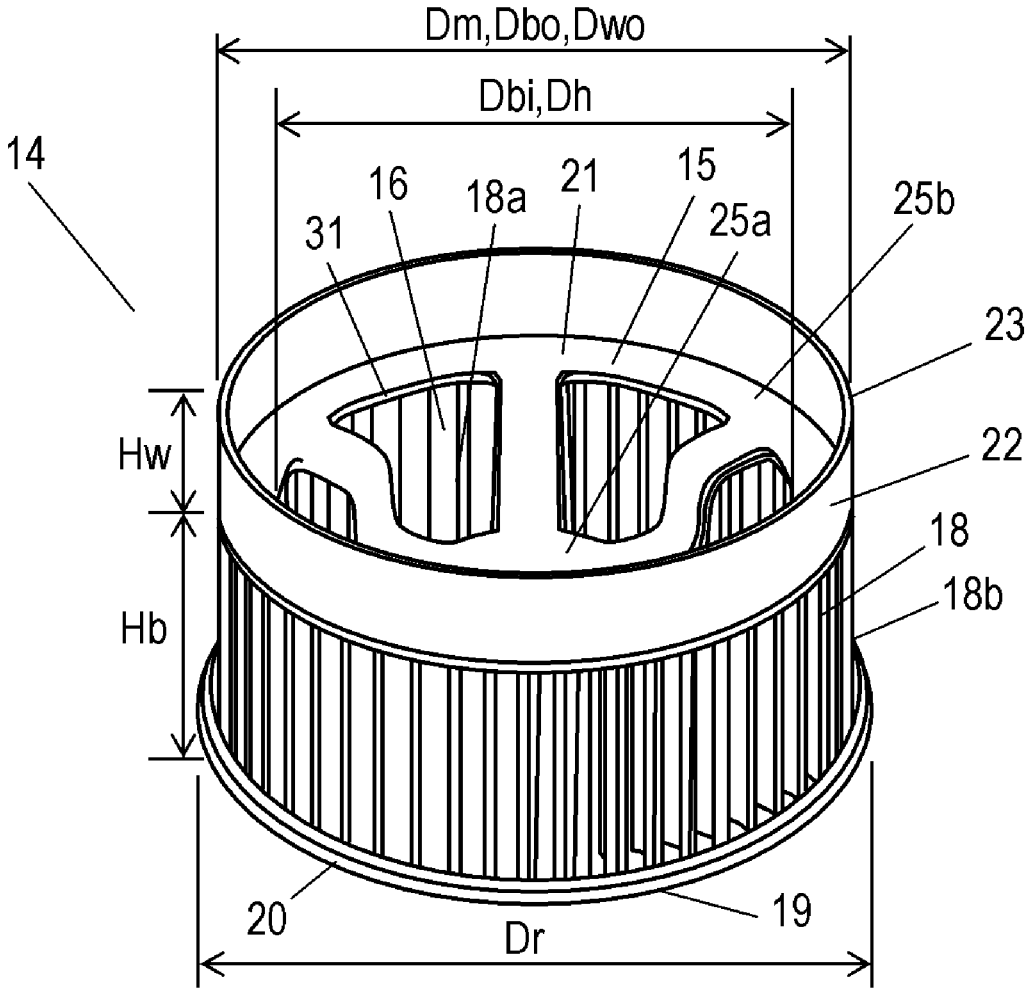
FIG. 2 is a perspective view of the centrifugal impeller shown in FIG. 1A.

Here will be described centrifugal impeller 14 and centrifugal air blower 1 of the first exemplary embodiment with reference to FIG. 1 and FIG. 2. Centrifugal air blower 1 (hereinafter referred to as air blower 1) shown in FIGS. 1 and 2 has outer wall 5; casing 10; air outlet 11; electric motor 13; and centrifugal impeller 14 (hereinafter, impeller 14). Outer wall 5 has bottom 2 as an opening and side 3 in which duct-connection opening 4 (hereinafter, opening 4) is formed. Outer wall 5 measures 258 mm square and 198 mm in height. Casing 10 is formed of air-intake plate 7, back plate 8, and side wall 9, which are disposed inside outer wall 5, in a manner that side wall 9 is held between air-intake plate 7 and back plate 8. Air-intake plate 7 has bell-mouthed air inlet 6 with inner diameter Do of 148 mm. Back plate 8 has a flat shape and faces air-intake plate 7. Side wall 9 has a spiral shape and has height Hc of 107 mm. Air outlet 11, which is disposed in side wall 9, is in open communication with opening 4. Electric motor 13 has rotary shaft 12 disposed concentric with air inlet 6 and is fixed to back plate 8. Electric motor 13 measures 75 mm in diameter, 80 mm in height. Impeller 14 with a multi-blade shape is fixed to rotary shaft 12 of electric motor 13. The multi-blade shape of impeller 14 enables air blower 1 to have a compact structure and to provide high pressure and low noise, characteristics which are needed for ventilation air blowers. Duct 50 is disposed outside opening 4. Tongue 42 is formed at a section that includes a minimum clearance between the outer periphery of impeller 14 and casing 10. Air blower 1 is used, for example, as a ceiling built-in ventilation fan for ventilation of a bathroom.

Impeller 14 has main plate 15, blades 18, ring-shaped plate 20, and cylindrical wall 22. Main plate 15 is formed into a disc with outer diameter Dm of 182 mm and a thickness of 3 mm. Six ventilation holes 16 are circumferentially disposed in main plate 15 so that intake air passes main plate 15 therethrough. Fifty pieces of blades 18 are connected to joint section 15*b* on the outer periphery of front side 17 of main plate 15 and are evenly spaced along the periphery. Such structured blades 18 form a multi-blade impeller having blade inner-periphery 18*a* and blade outer-periphery 18*b*. Blade outer-diameter Dbo of blade outer-periphery 18*b* equals outer diameter Dm (=182 mm) of main plate 15. Similarly, blade inner-diameter Dbi of blade inner-periphery 18*a* equals inner diameter Do (=148 mm) of air inlet 6. Blades 18 have height Hb of 77 mm. Ring-shaped plate 20 is attached to the outer periphery of tip sections 19 of blades 18. Ring-shaped plate 20 has outer diameter Dr of 191.5 mm and a height of 3 mm. Cylindrical wall 22 is disposed on back side 21 of main plate 15 so as to be concentric therewith. Cylindrical wall 22 has outer diameter Dwo of 182 mm that is the same size as blade outer-periphery Dbo. Cylindrical wall 22 has height Hw of 27 mm, which falls within the range of at least 30% and at most 40% of height Hb of blades 18, and a thickness of 2 mm. Edge 23 of cylindrical wall 22 and back plate 8 have 3 mm-clearence 24 therebetween. Center 25*a* of main plate 15 protrudes by 30 mm toward air inlet 6. Main plate 15 has main-plate projection 15*a* that is gently inclined from center 25*a* toward outer periphery 25*b* so as to form a cone shape. Ventilation holes 16, each of which has substantially a sector shape seen from the rotary shaft, have outer periphery Dh that is the same size (=145 mm) as blade inner-periphery Dbi. Besides, the area between ventilation holes 16 and outer periphery 25*b*, i.e. joint section 15*b* has a radially-outward inclination from outer-periphery edge 31 of ventilation holes 16 toward cylindrical wall 22. That is, joint section 15*b* inclines to cylindrical wall 22 as it extends in a radially-outward direction. Front side 17 of main plate 15 is the surface that faces air inlet 6 of main plate 15. On the other hand, back side 21 of main plate 15 is the surface that faces back plate 8 of main plate 15.

As described above, impeller 14 has cylindrical wall 22. Back plate 8 has a flat shape. That is, height Hc (=107 mm) of side wall 9 is greater than height Hb (=77 mm) of blades 18 by height Hw of cylindrical wall 22. The structure increases the channel of casing 10, and accordingly, increases the volume of air of flow 28. Besides, the flat shape of back plate 8 contributes to cost-reduced impeller 14. As a result, impeller 14 and air blower 1 with a cost-reduced structure and improved air-blow efficiency are easily obtained.

Electric motor 13 is accommodated in cylindrical wall 22 in a way that the half of motor 13 protrudes, through motor-fixing hole 26 of back plate 8, into casing 10. By virtue of the cone shape of main plate 15, it is no worry that electric motor 13 can make contact with impeller 14.

In air blower 1, a driving force fed from electric motor 13 via rotary shaft 12 rotates impeller 14. The rotation of impeller 14 allows intake air 27 to enter through air inlet 6 into blades 18, increasing pressure. Further, when the intake air 27 flows out of blades 18 and passes through the casing 10, the intake air 27 undergoes efficient changes in pressure from dynamic form to static form. The intake air 27 goes out from air outlet 11, via duct 50, to the outside of air blower 1.

In the process above, intake air 27 is taken into tip sections 19 and flows out of blades 18 as flow 28 that goes in a slanting direction. As described above, height Hc (=107 mm) of side wall 9 is greater than height Hb (=77 mm) of blades 18 by height Hw of cylindrical wall 22. That is, the distance between the area outside impeller 14 in back plate 8 and air inlet 6 is greater than the distance between main plate 15 and air inlet 6. By virtue of the structure, flow 28 flown out of blades 18 collides with back plate 8 at a slower speed, increasing air-blow efficiency of impeller 14 and air blower 1.

Cylindrical wall 22 is disposed on back side 21 of main plate 15 so as to be concentric therewith. Accordingly, the cylindrical wall 22 can suppress the flow 28 to the side of back plate 21, thereby allowing the flow to be insusceptible to friction from back side 21 and to not have turbulence. As a result, a decrease in air-blow efficiency of the impeller 14 and air blower 1 is restrained. Further, the cylindrical wall 22 rotating with the impeller 22 generates friction against the rotation of cylindrical wall 22, so that a force is applied to flow 28 fed out of blades 18 in the rotating direction, thereby increasing air-blow efficiency of the impeller 14 and air blower 1.

The flow which comes from blades 18 and passes through the casing 10 has a high pressure. Therefore, flow 28 from blades 18 partly flows into a space 24 between impeller 14 and back plate 8, generating backflow 29. However, the cylindrical wall 22 disposed concentric to main plate 15 reduces the amount of backflow 29. Further, ventilation holes 16 formed in main plate 15 suppress a stagnant state of backflow 29, thereby preventing air-blow performance of air blower 1 from degradation.

In addition, ventilation holes 16 suppress intake air 27 from colliding with the main plate 15 and flowing into the blades 18. Further, ventilation holes 16 allow intake air 27 and circulation flow 30 to be led to the electric motor 13, thereby encouraging the cooling of electric motor 13.

In addition, having ventilation holes 16 allows backflow 28 to go back to blades 18, producing circulation flow 30. In the process above, by virtue of cylindrical wall 22, backflow 29 is generated away from blades 18 and therefore is unlikely to collide with flow 28 fed from blades 18 in the periphery of blades 18 on the side of main plate 15. As a result, blades 18 adjacent to main plate 15 efficiently work, maintaining air-blow efficiency of air blower 1. In addition, because of the low possibility of collision between flow 28 and backflow 29, turbulence noise is suppressed. In this way, the structure above provides air blower 1 and impeller 14 with increase in air-blow efficiency and decrease in noise.

In the process above, an amount of flow 28 from blades 18 oppositely goes toward back side 21, passes through ventilation holes 16 and flows back into blades 18. At that time, turbulence can easily occur in the air flow at outer-periphery edge 31 of ventilation holes 16. According to the structure of the embodiment, however, blade inner-diameter Dbi of blades 18 equals outer diameter Dh of ventilation holes 16. The structure suppresses a turbulent flow in the air flow going back into blades 18. This suppresses not only degradation in air-blow efficiency but also turbulence noise. That is, the structure above provides air blower 1 with increase in air-blow efficiency and decrease in noise.

In the process above, an amount of flow 28 from blades 18 oppositely goes toward back side 21. At that time, when main plate 15 and cylindrical wall 22 form a step therebetween, turbulence easily occurs in the air flow. According to the structure of the embodiment, however, outer diameter Dbo of blades 18 equals outer diameter Dwo of cylindrical wall 22, by which backflow 29 has little turbulence. This suppresses not only degradation in air-blow efficiency but also turbulence noise. That is, the structure above provides air blower 1 with increase in air-blow efficiency and decrease in noise.

In the process above, an amount of flow 28 from blades 18 flows in an opposite direction, producing circulation flow 30. According to the structure above, main plate 15 has a cone-shaped projection 15*a* inside blades 18, allowing ventilation holes 16 to have a large three-dimensional area. By virtue of the structure, circulation flow 30 smoothly passes through ventilation holes 16 and flows back into blades 18 with little turbulence. This suppresses degradation in air-blow performance and turbulence noise. That is, the structure above provides air blower 1 with an increase in air-blow efficiency and a decrease in noise.

In addition, joint section 15*b* between main plate 15 and blades 18—the area between ventilation holes 16 and outer periphery 25*b*—has a radially-outward inclination from outer-periphery edge 31 toward cylindrical wall 22. That is, joint section 15*b* inclines to cylindrical wall 22 as it extends in a radially-outward direction. By virtue of the structure of joint section 15*b*, intake air 27 has a gradual increase in channel area while passing through blades 18, and after flowing out of blades 18, flow 28 has a sharp increase. This suppresses enlargement losses of the flow. That is, the structure above provides air blower 1 with increase in air-blow efficiency.

According to the structure of the embodiment, electric motor 13 is partly located inside cylindrical wall 22. Therefore, the total height of impeller 14 and electric motor 13 can be kept small. This contributes to low-profile air blower 1.

Height Hw of cylindrical wall 22 is determined so as to fall within the range of at least 30% and at most 40% of height Hb of blades 18. The structure enhances the effect of avoiding collision between flow 28 and backflow 29. That is, the structure above provides air blower 1 and impeller 14 with increase in air-blow efficiency and decrease in noise. At the same time, this provides air blower 1 and impeller 14 with further low-profile structure.

Cylindrical wall 22 may be formed by resin molding. In that case, to obtain the aforementioned effect, such formed cylindrical wall 22 has to have a gradient approximately the same as draft. Besides, even if cylindrical wall 22 has irregularities caused by strengthening ribs, unless they hinder the path of circulation flow 30, the aforementioned effect is obtained. Back plate 8 is formed into a flat shape. Back plate 8 may undergoes some processes for reinforcement or for attaching other components thereto, such as embossing, hole-drilling, and bending on the outer periphery. Such processed back plate offers the same effect.

Figure 3A:
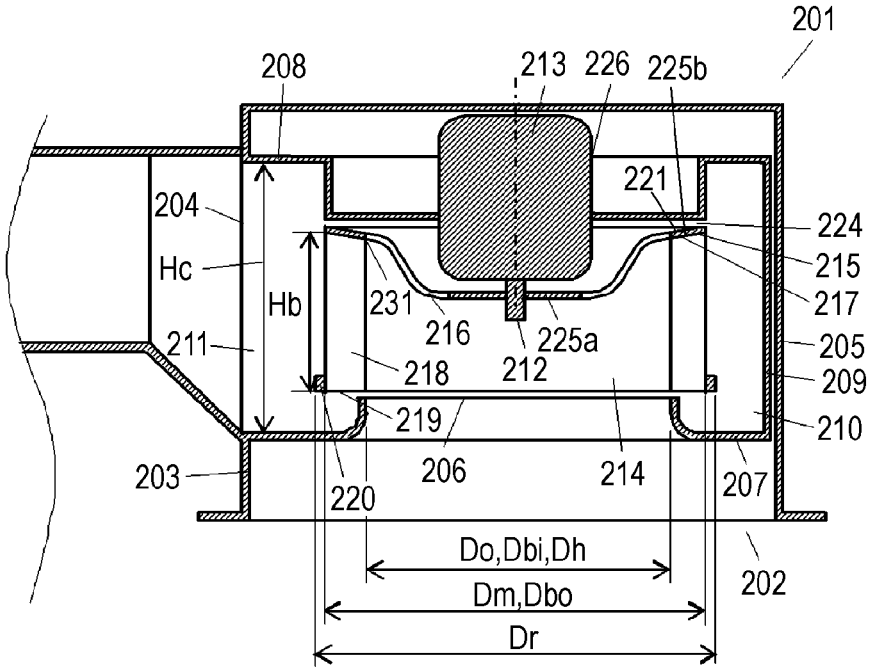
FIG. 3A is a side sectional view of a centrifugal air blower for making a comparison with the centrifugal air blower in accordance with the first exemplary embodiment of the present invention.
Figure 3B:
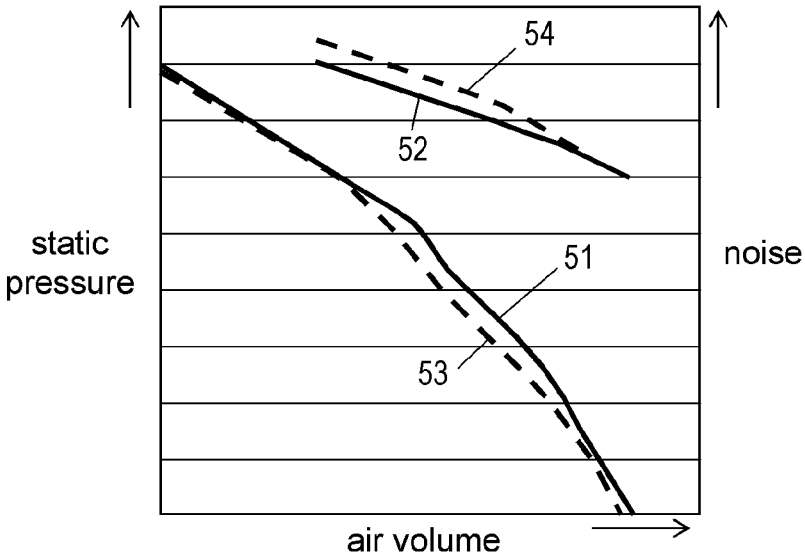
FIG. 3B shows characteristics of the centrifugal impeller and the centrifugal air blower shown in FIG. 1A.

Next will be described the effect brought by centrifugal impeller 14 and centrifugal air blower 1 of the present invention with reference to FIG. 3A and FIG. 3B. FIG. 3A is a side sectional view of centrifugal air blower 201 (hereinafter, air blower 201) for making a comparison with air blower 1 of the present invention. FIG. 3B shows characteristics (i.e. air-volume to static-pressure, and air-volume to noise) of blower 1 and air blower 201.

As is shown in FIG. 3A, air blower 201 has no cylindrical wall 22 that is disposed in air blower 1. In air blower 201, back plate 208 extends in the place corresponding to cylindrical wall 22 of air blower 1. That is, space 224 between back side 221 of main plate 215 and back plate 208 in air blower 201 equals space 24 between edge 23 and back plate 8 in air blower 1. As for other dimensions, for example, blade outer-diameter Dbo of centrifugal impeller 214, blade height Hb, and height Hc of side wall 209 of casing 210 are the same as those of air blower 1 of the present invention.

Air blower 201 has outer wall 205; casing 210; air outlet 211; electric motor 213; and centrifugal impeller 214 (hereinafter, impeller 214). Outer wall 205 has bottom 202 as an opening and side 203 in which duct-connection opening 204 is formed. Casing 210 has air-intake plate 207, back plate 208, and side wall 209. Air-intake plate 207 has air inlet 206 with inner diameter Do of 148 mm. Side wall 209 has height Hc of 107 mm. Air outlet 211, which is disposed in side wall 209, is in open communication with opening 204. Electric motor 213 has rotary shaft 212 disposed concentric with air inlet 206. Motor 213 is fixed, through motor-fixing hole 226, to back plate 208. Impeller 214 with a multi-blade shape is fixed to rotary shaft 212 of electric motor 213.

Impeller 214 has main plate 215, blades 218, ring-shaped plate 220. Main plate 215 is formed into a disc with outer diameter Dm of 182 mm. Ventilation holes 216 are circumferentially disposed in main plate 215. Blades 218 connected on the side of the outer periphery of front side 217 of main plate 215 are evenly spaced along the periphery. Such structured blades 218 form a multi-blade impeller. Blade outer-diameter Dbo of blades 218 equals outer diameter Dm of main plate 215. Similarly, blade inner-diameter Dbi equals inner diameter Do of air inlet 206. Blades 18 have height Hb. Ring-shaped plate 220 is attached to the outer periphery of tip sections 219 of blades 218. Ring-shaped plate 220 has outer diameter Dr of 191.5 mm and a height of 3 mm. Main plate 215 has a shape that is gently inclined from center 225*a* toward outer periphery 225*b* so as to form a cone shape. Each of ventilation holes 216 has substantially a sector shape seen from the rotary shaft. Outer diameter Dh of ventilation holes 216 equals blade inner-periphery Dbi (=145 mm). Besides, the area between ventilation holes 216 and outer periphery 225*b* in main plate 215 has a radially-outward inclination. That is, the area between ventilation holes 216 and outer periphery 225*b* inclines to cylindrical wall 22 as it extends in a radially-outward direction.

In FIG. 3B, solid line 51 shows air-volume to static-pressure characteristics and solid line 52 shows air-volume to noise characteristics of air blower 1 of the present invention. Similarly, dotted line 53 shows air-volume to static-pressure characteristics and dotted line 54 shows air-volume to noise characteristics of air blower 201 structured for making comparison to air blower 1. Compared to air blower 201 with no cylindrical wall 22, as shown in FIG. 3B, air blower 1 maintains a higher static pressure and a lower noise for the same air volume. As described earlier, an amount of flow 28 flown out of blades 18 flows through ventilation holes 16 as backflow 29 and back into blades 18, producing circulation flow 30. In the process above, by virtue of cylindrical wall 22, backflow 29 is generated away from blades 18 and therefore is unlikely to collide with flow 28 fed from blades 18 in the periphery of blades 18 on the side of main plate 15. As a result, blades 18 adjacent to main plate 15 efficiently work, maintaining air-blow efficiency of air blower 1. In addition, because of the low possibility of collision between flow 28 and backflow 29, turbulence noise is suppressed. As is apparent from FIG. 3B, the structure above provides air blower 1 and impeller 14 with increase in air-blow efficiency and decrease in noise.

Second Exemplary Embodiment

Figure 4A:
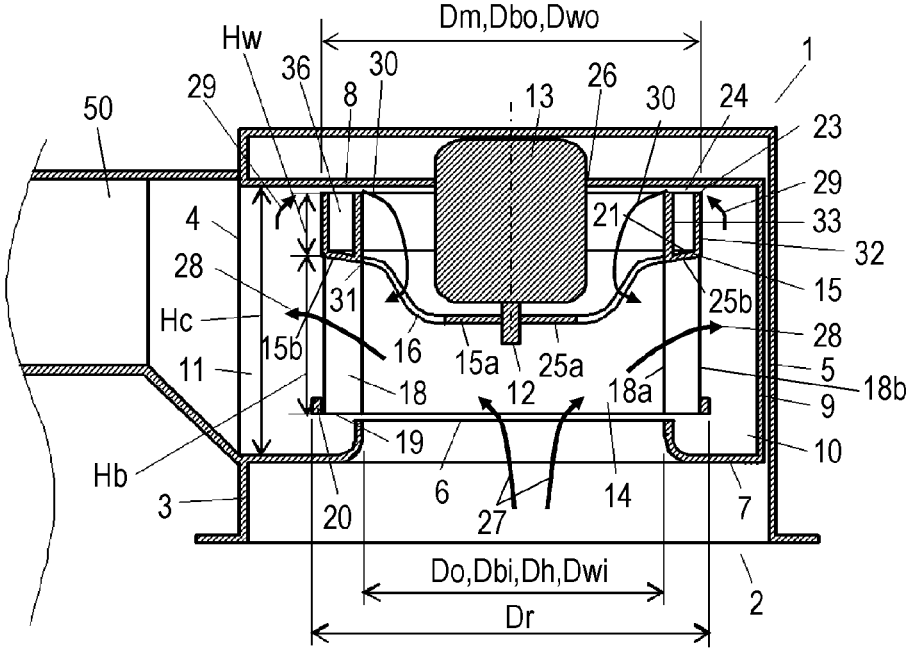
FIG. 4A is a side sectional view showing a centrifugal impeller and a centrifugal air blower in accordance with a second exemplary embodiment of the present invention.
Figure 4B:
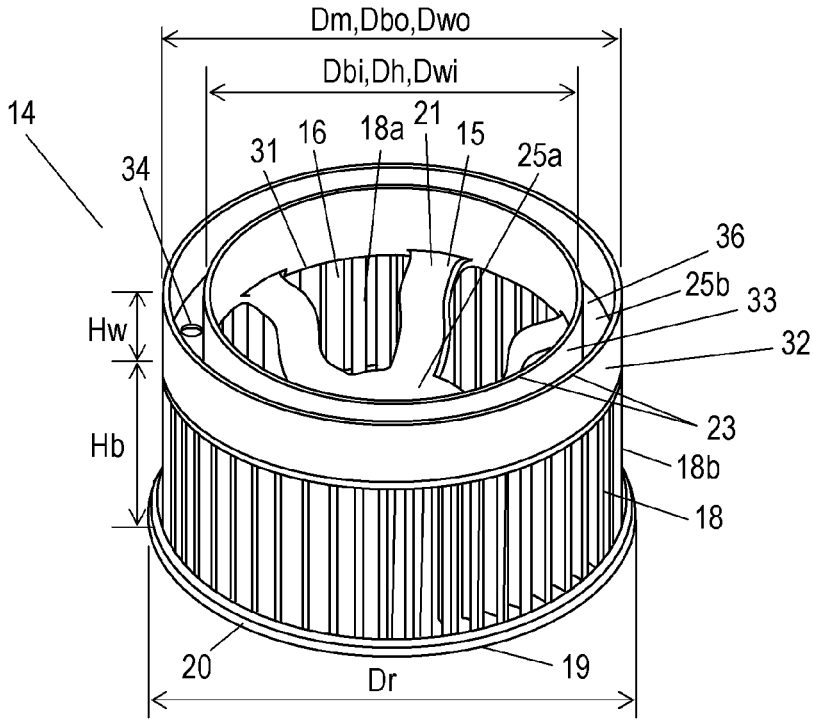
FIG. 4B is a perspective view of the centrifugal impeller shown in FIG. 4A.

FIGS. 4A and 4B show centrifugal impeller 14 and centrifugal air blower 1 of the second exemplary embodiment. In the drawings, the same reference marks are used as in the structure described in the first embodiment for similar parts and in-detail explanations thereof will be omitted. According to the centrifugal air blower 1 of the embodiment, as shown in FIGS. 4A and 4B, cylindrical wall 22 disposed on back side 21 has a double-walled structure formed of outer cylindrical wall 32 (hereinafter, wall 32) and inner cylindrical wall 33 (hereinafter, wall 33). Wall 32 forms the outer periphery of cylindrical wall 22 and has outer diameter Dwo of 182 mm. Wall 33 forms the inner periphery of cylindrical wall 22 and has inner diameter Dwi of 145 mm that is equal to outer diameter Dh of ventilation holes 16. Wall 33 has a thickness of 2 mm. Edge 23 of wall 33 is flush with edge 23 of wall 32. Wall 32 and wall 33 form cylindrical space 36 (hereinafter, space 36) therebetween. Drain hole 34 is disposed between wall 32 and wall 33, specifically, disposed in main plate 15 in space 36.

With the structure above, wall 32 and wall 33 of impeller 14 allow backflow 29 to be double-blocked, decreasing the amount of circulation flow 30; accordingly, increasing air-blow efficiency of air blower 1.

In the process above, an amount of flow 28 from blades 18 oppositely goes toward back side 21 of main plate 15 and then passes through ventilation holes 16 of main plate 15 to go back into blades 18. At that time, when main plate 15 and wall 33 form a step therebetween, turbulence easily occurs in the air flow. According to the structure of the embodiment, however, inner diameter Dwi of wall 33 equals outer diameter Dh of ventilation holes 16, by which the air flow enters in blades 18 with little turbulence. This suppresses not only degradation in air-blow performance but also turbulence noise. That is, the structure above provides air blower 1 with increase in air-blow efficiency and decrease in noise.

Besides, air blower 1 has drain hole 34. Forming drain hole 34 prevents moisture in the air from being left in space 36 due to condensation. That is, the structure prevents the problem of water accumulated in the space 36 from colliding with the side wall 9 and then dropping downward from air inlet 6 upon the operation of air blower 1.

Although drain hole 34 is disposed in main plate 15 in air blower 1 shown in FIG. 4, it is not limited to. For example, drain hole 34 may be formed in wall 32 or wall 33. As long as the drain hole is disposed at least any one of main plate 15 and cylindrical wall 22 that forms space 36, the same effect is expected.

Third Exemplary Embodiment

Figure 5:
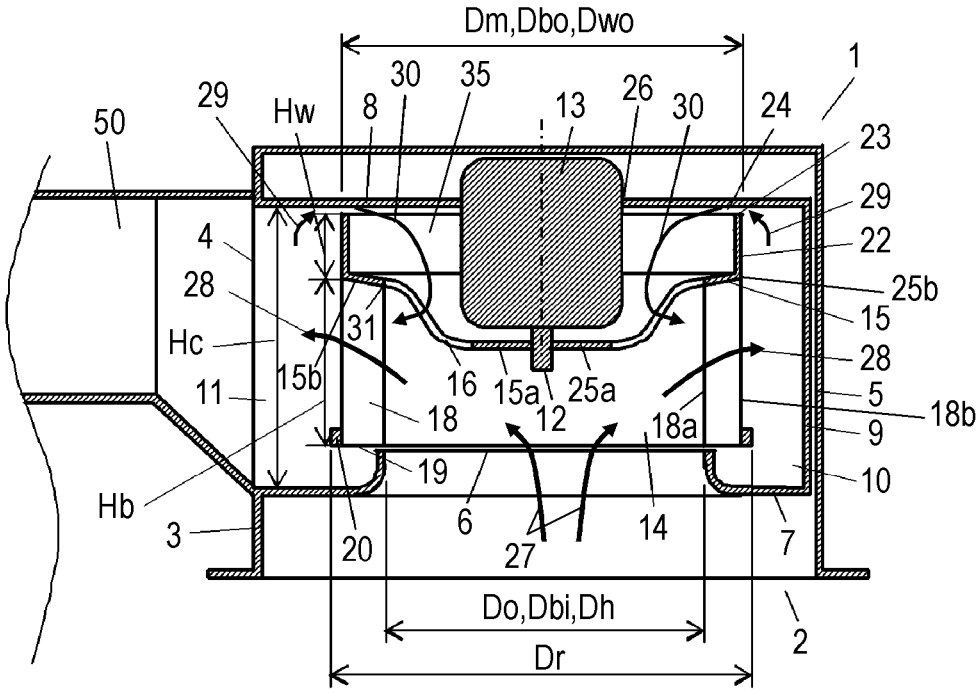
FIG. 5 is a side sectional view showing a centrifugal impeller and a centrifugal air blower in accordance with a third exemplary embodiment of the present invention.

FIG. 5 shows centrifugal impeller 14 and centrifugal air blower 1 in accordance with the third exemplary embodiment of the present invention. In the drawing, the same reference marks are used as in the structure described in the first and the second embodiments for similar parts and in-detail explanations thereof will be omitted. According to centrifugal air blower 1 of the embodiment, as shown in FIG. 5, cylindrical wall 22 is formed of sound-absorbing material 35, such as rigid polyurethane foam. Sound-absorbing material 35 absorbs noise generated in the periphery of impeller 14, decreasing noise generated in air blower 1 and impeller 14.

In a case where sound-absorbing material 35 of the third embodiment is employed for impeller 14 of the second embodiment, the same effect is expected as long as at least any one of wall 32 and wall 33 that form the double cylinder shape of cylindrical wall 22 is made of sound-absorbing material 35.

Fourth Exemplary Embodiment

Figure 6A:
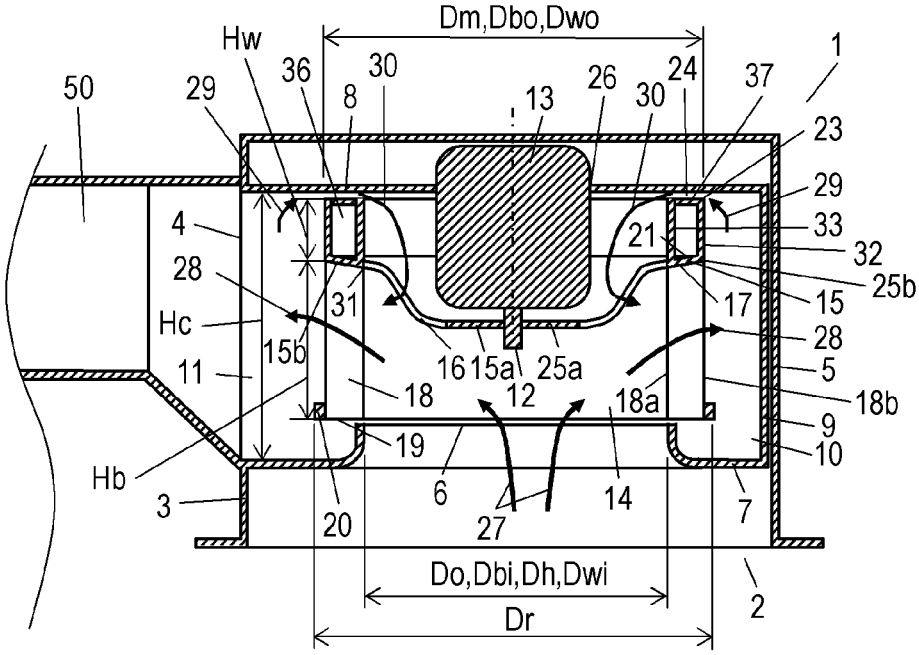
FIG. 6A is a side sectional view showing a centrifugal impeller and a centrifugal air blower in accordance with a fourth exemplary embodiment of the present invention.
Figure 6B:
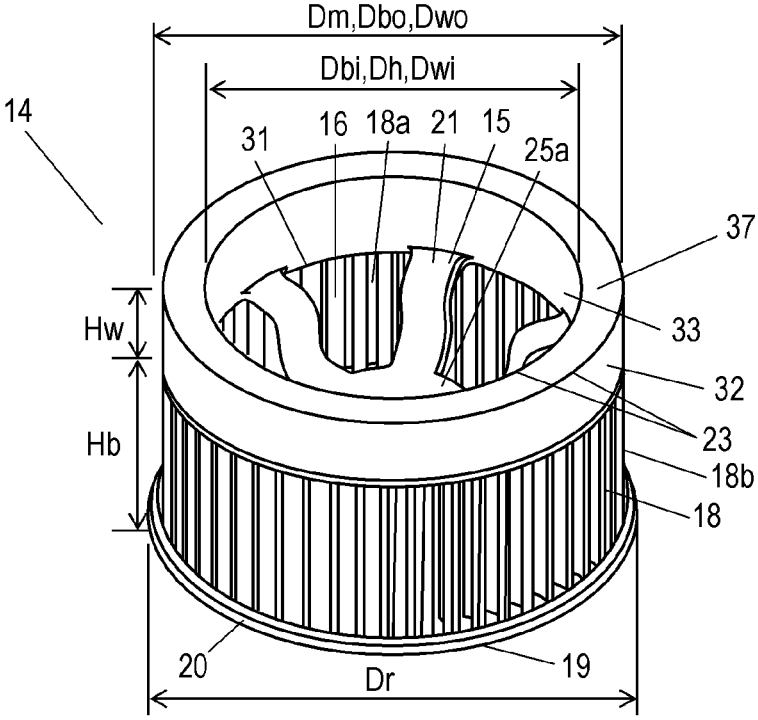
FIG. 6B is a perspective view of the centrifugal impeller shown in FIG. 6A.

FIGS. 6A and 6B show centrifugal impeller 14 and centrifugal air blower 1 in accordance with the fourth exemplary embodiment of the present invention. In the drawings, the same reference marks are used as in the structure described in the first through the third embodiments for similar parts and in-detail explanations thereof will be omitted. Centrifugal air blower 1 of the embodiment has, as shown in FIG. 6, lid 37 for covering space 36 formed between inner cylindrical wall 33 and outer cylindrical wall 32. Lid 37 has a width so as to cover the distance between wall 32 and wall 33 in the radial direction of main plate 15.

In air blower 1, an amount of flow 28 from blades 18 oppositely goes toward back side 21. At this time, lid 37 having a radially extending width blocks the backflow, decreasing air volume of circulation flow 30. As a result, the structure improves air-blow efficiency of air blower 1.

Space 36 formed of wall 33, wall 32, and lid 37 is not necessarily to be hollow; it may be an integrated structure filled with packing material. In that case, the same effect is expected.

Fifth Exemplary Embodiment

Figure 7:
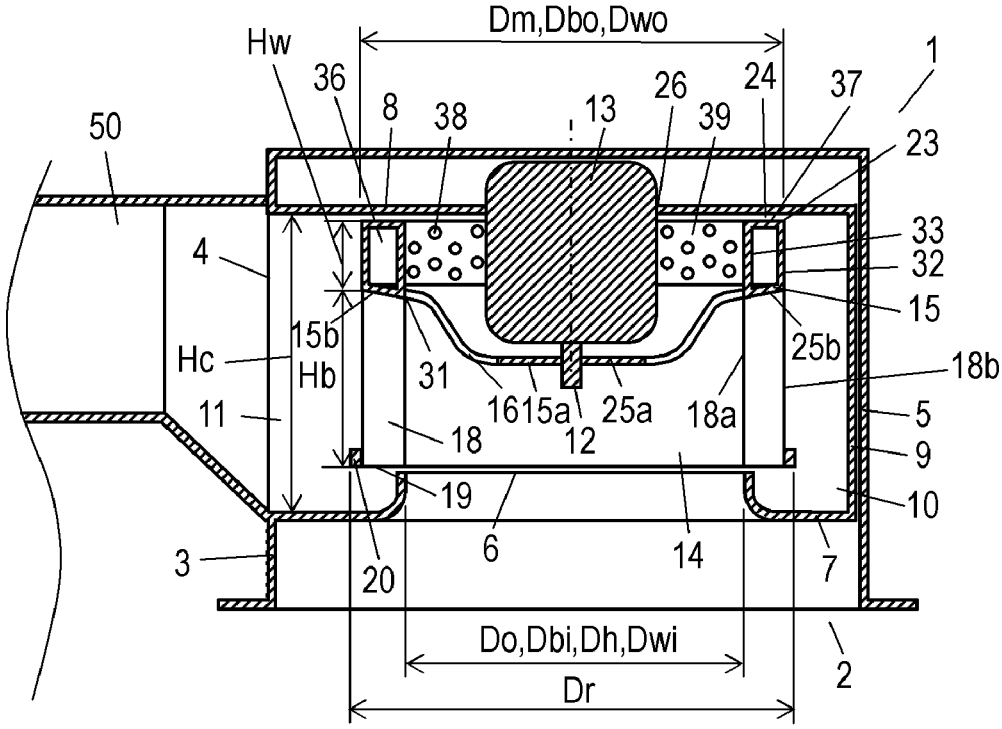
FIG. 7 is a side sectional view showing a centrifugal impeller and a centrifugal air blower in accordance with a fifth exemplary embodiment of the present invention.

FIG. 7 shows centrifugal impeller 14 and centrifugal air blower 1 in accordance with the fifth exemplary embodiment of the present invention. In the drawing, the same reference marks are used as in the structure described in the first through the fourth embodiments for similar parts and in-detail explanations thereof will be omitted. According to centrifugal air blower 1 of the embodiment, as shown in FIG. 7, inner cylindrical wall 33 is formed of perforated board 39 made of, for example, a hard fiber board. Having an aperture ratio of 10%, perforated board 39 has a plurality of small holes 38 with a diameter of 5 mm. Employing perforated board 39 for air blower 1 forms a perforated-board sound-absorbing structure. Specifically, air trapped in small holes 38 of perforated board 39 serves as a mass component; on the other hand, space 36 formed by wall 33, wall 32, and lid 37 serves as back airspace, which form a vibration system. This is a perforated-board sound-absorbing structure that absorbs sounds through a mechanism similar to Helmholtz resonator as an example of a resonant sound-absorbing structure. The structure thus decreases noise generated in the periphery of impeller 14, and accordingly, decreases noise of air blower 1.

Sixth Exemplary Embodiment

Figure 8:
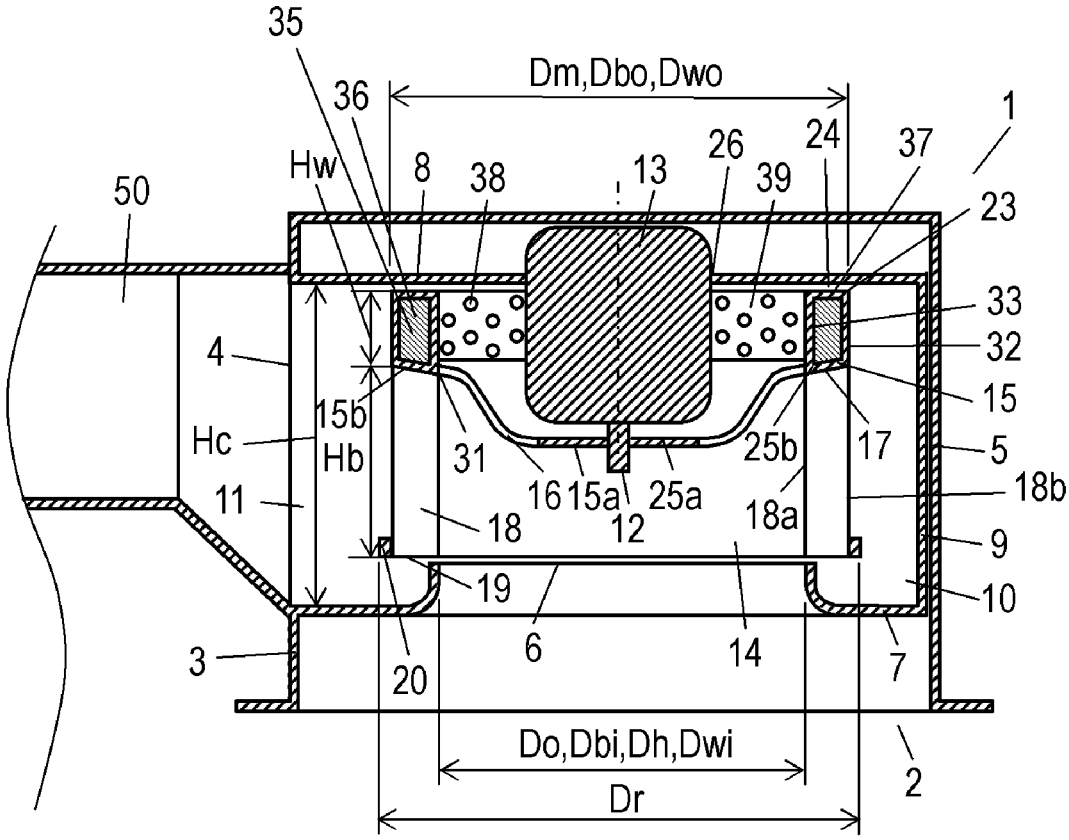
FIG. 8 is a side sectional view showing a centrifugal impeller and a centrifugal air blower in accordance with a sixth exemplary embodiment of the present invention.

FIG. 8 shows centrifugal impeller 14 and centrifugal air blower 1 in accordance with the sixth exemplary embodiment of the present invention. In the drawing, the same reference marks are used as in the structure described in the first through the fifth embodiments for similar parts and in-detail explanations thereof will be omitted. According to centrifugal air blower 1 of the embodiment, as shown in FIG. 8, inner cylindrical wall 33 is formed of perforated board 39. In addition, space 36 formed by inner cylindrical wall 33, outer cylindrical wall 32, and lid 37 is filled with sound-absorbing material 35. Having an aperture ratio of 10%, perforated board 39 has a plurality of small holes 38 with a diameter of 5 mm. Perforated board 39 is formed of, for example, a hard fiber board. Sound-absorbing material 35 is formed of, for example, glass wool.

With the structure above, as is the case with air blower 1 of the fifth embodiment, the perforated-board sound-absorbing structure formed in the air blower of the embodiment eliminates noise. In addition, sound-absorbing material 35 further absorbs sounds. As a result, the structure further decreases noise generated in the periphery of impeller 14, and accordingly, decreases noise of air blower 1.

Seventh Exemplary Embodiment

Figure 9:
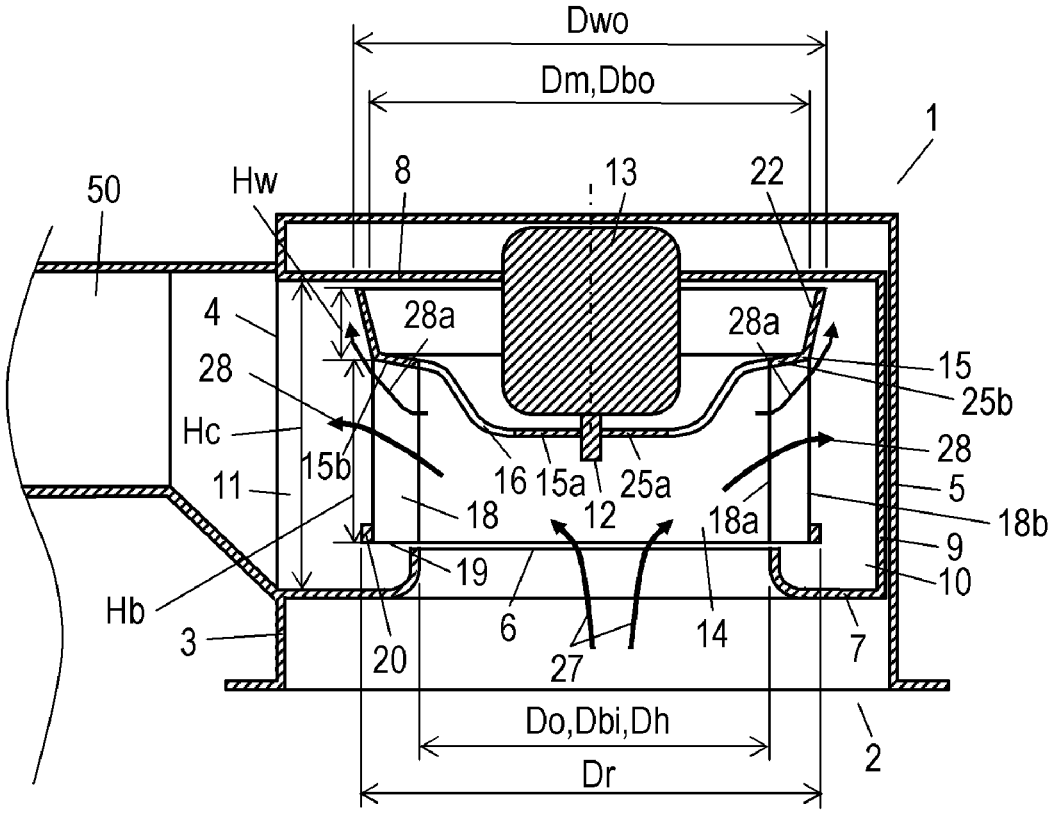
FIG. 9 is a side sectional view showing a centrifugal impeller and a centrifugal air blower in accordance with a seventh exemplary embodiment of the present invention.

FIG. 9 shows centrifugal impeller 14 and centrifugal air blower 1 in accordance with the seventh exemplary embodiment of the present invention. In the drawing, the same reference marks are used as in the structure described in the first through the sixth embodiments for similar parts and in-detail explanations thereof will be omitted. According to centrifugal air blower 1 of the embodiment, as shown in FIG. 9, cylindrical wall 22 has a bowl shape where outer diameter Dwo gradually increases toward edge 23. Cylindrical wall 22 has a maximum inner diameter of 200 mm.

According to the structure of air blower 1 shown in FIG. 9, intake air 27 is captured on the side of tip sections 19. Flow 28, which is flown out of blades 18, travels along front side 17 and, after coming out of blades 18, continues to flow in a slanting direction. The shape of cylindrical wall 22 in which outer diameter Dwo has a gradual increase toward edge 23 allows flow 28 coming from blades 18 in a slanting direction to be guided along cylindrical wall 22, forming flow 28*a*. In this way, flow 28*a* on the outer periphery of main plate 15 is prevented from going away from cylindrical wall 22. This suppresses decrease in air-blow efficiency. As a result, the structure improves air-blow efficiency of air blower 1 and impeller 14.

Eighth Exemplary Embodiment

Figure 10:
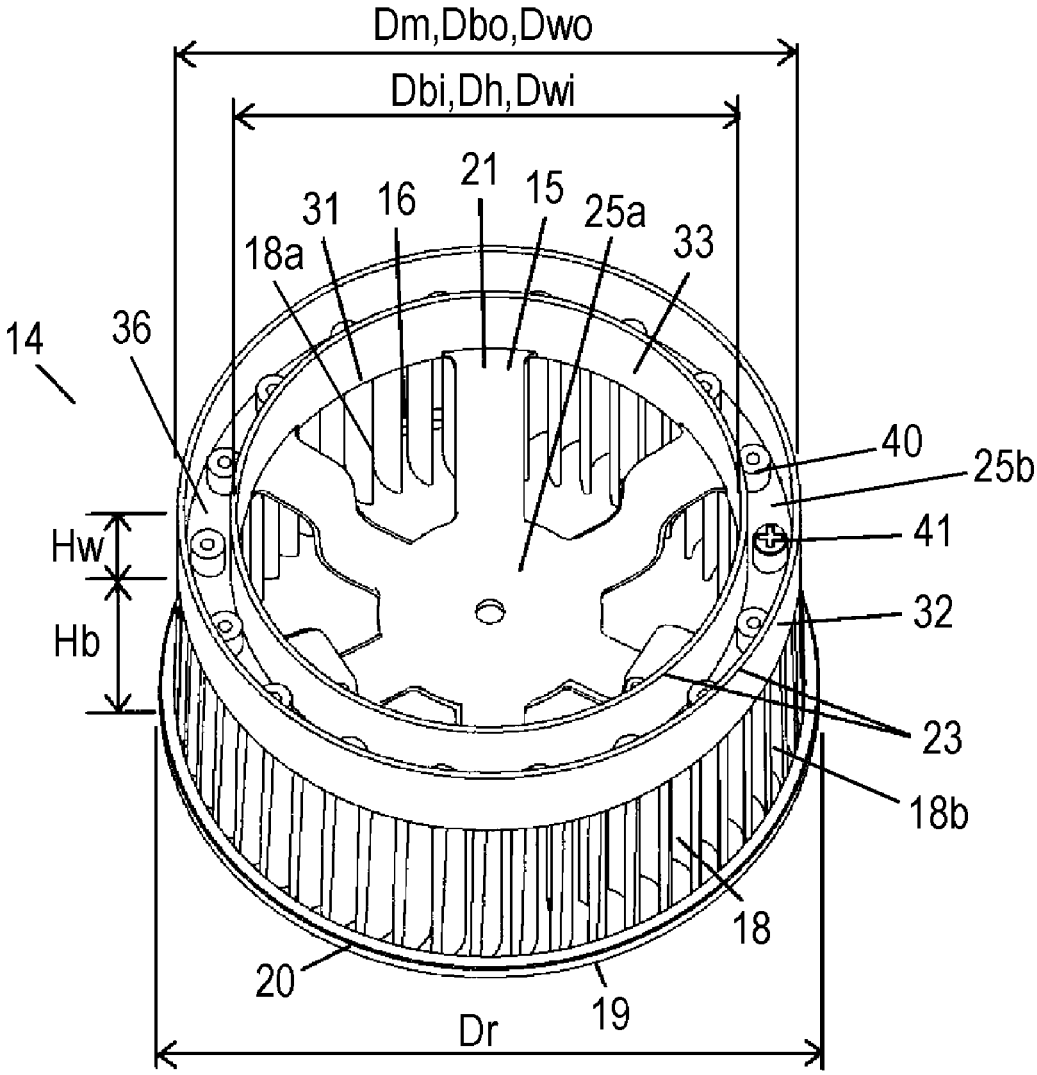
FIG. 10 is a perspective view of a centrifugal impeller in accordance with an eighth exemplary embodiment of the present invention.

FIG. 10 shows centrifugal impeller 14 in accordance with the eighth exemplary embodiment of the present invention. In the drawing, the same reference marks are used as in the structure described in the first through the seventh embodiments for similar parts and in-detail explanations thereof will be omitted. According to impeller 14 of the embodiment, as shown in FIG. 10, a plurality of screw bosses 40 is circumferentially disposed in space 36. In the structure, screws 41 are fixed in bosses 40 so that they serve as weights for rotation balance of impeller 14. When backflow 29 collides with screws 41 as the weights, the air volume of backflow 29 is suppressed. This suppresses degradation of air-blow efficiency and turbulence noise. As a result, the structure improves air-blow efficiency and decreases noise of air blower 1 and impeller 14.

Ninth Exemplary Embodiment

Figure 11:
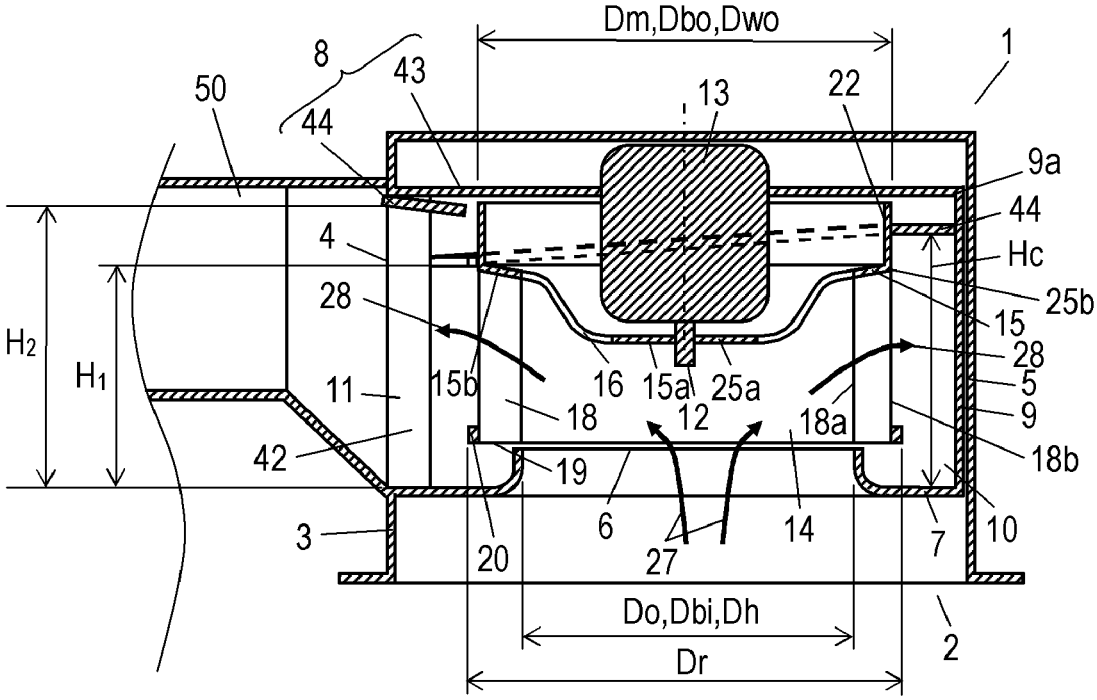
FIG. 11 is a side sectional view showing a centrifugal impeller and a centrifugal air blower in accordance with a ninth exemplary embodiment of the present invention.

FIG. 11 shows centrifugal impeller 14 and centrifugal air blower 1 in accordance with the ninth exemplary embodiment of the present invention. In the drawing, the same reference marks are used as in the structure described in the first through the eighth embodiments for similar parts and in-detail explanations thereof will be omitted. According to centrifugal air blower 1 of the embodiment, as shown in FIG. 11, back plate 8 has main part 43 and helical plate 44. Main part 43 is connected to edge 9*a* of side wall 9. Helical plate 44 has a helical shape that inclines from tongue 42 toward air outlet 11. In addition, height Hc of side wall 9 gradually increases from around tongue 42 toward air outlet 11. That is, in the periphery of tongue 42, helical plate 44 has an axial position (i.e. height $H_1$) the same as main plate 15; and in the periphery of air outlet 11, it has an axial position (i.e. height $H_2$) the same as cylindrical wall 22.

As described above, air blower 1 has helical plate 44 that inclines from tongue 42 toward air outlet 11. With the structure above, flow 28 from blades 18 collides with helical plate 44 and changes the flowing direction toward air outlet 11. This improves air-blow efficiency of air blower 1. Besides, in the periphery of air outlet 11, helical plate 44 has an axial position the same as cylindrical wall 22, allowing air blower 1 to have a low-profile structure in a direction of rotary shaft. Further, helical plate 44 is formed as an individual part separated from the main part 43. That is, both of the main part 43 and the helical plate 44 are formed into a simple structure. This allows back plate 8 to be formed simple, decreasing production cost of impeller 14 and air blower 1.

Tenth Exemplary Embodiment

Figure 12:
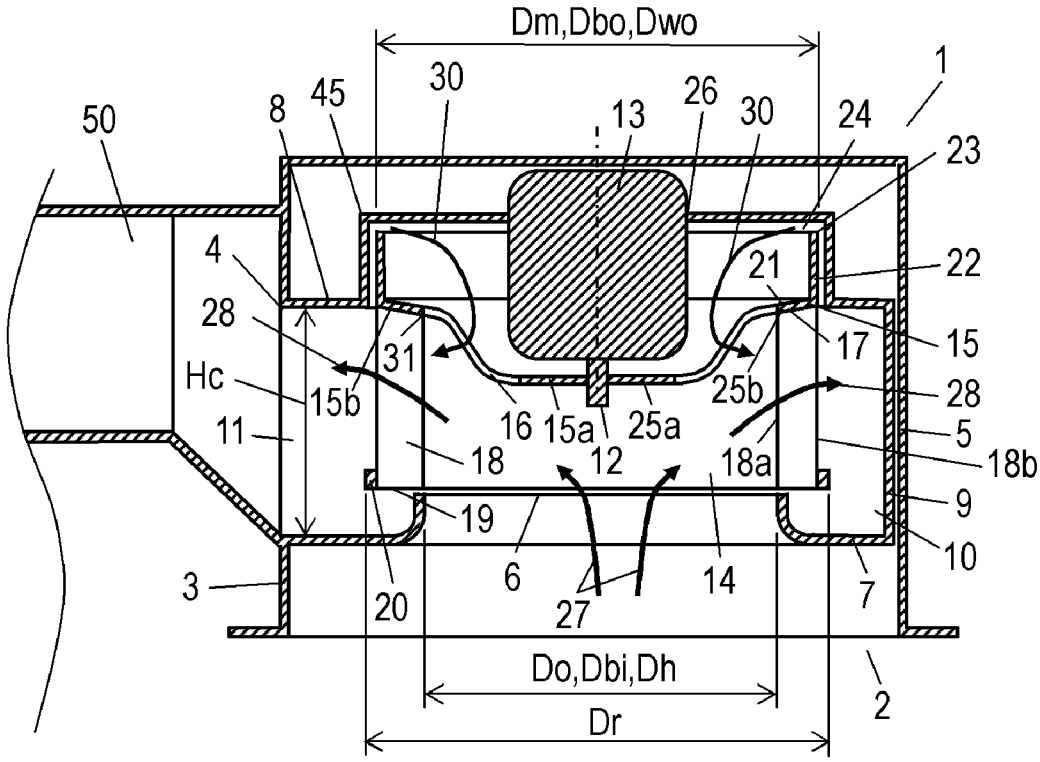
FIG. 12 is a side sectional view showing a centrifugal impeller and a centrifugal air blower in accordance with a tenth exemplary embodiment of the present invention.

FIG. 12 shows centrifugal impeller 14 and centrifugal air blower 1 in accordance with the tenth exemplary embodiment of the present invention. In the drawing, the same reference marks are used as in the structure described in the first through the ninth embodiments for similar parts and in-detail explanations thereof will be omitted. According to centrifugal air blower 1 of the embodiment, as shown in FIG. 12, back plate 8 has back-plate projection 45. Back plate 8 and main plate 15 are positioned axially identical with respect to rotary shaft 12. Back-plate projection 45 protrudes outside casing 10 to be concentric with impeller 14.

As described above, flow 28 from blades 18 partly goes in an opposite direction toward back side 21. At that time, the structure above allows the backward flow to meet with an increased area of back plate 8 and cylindrical wall 22, serving a barrier against the flow and decreasing the amount of circulation flow 30. Besides, the structure prevents flow 28 flown out of blades 18 from having a sudden increase in volume, suppressing enlargement loss. As a result, the structure improves air-blow efficiency of air blower 1 and impeller 14.

Eleventh Exemplary Embodiment

Figure 13:
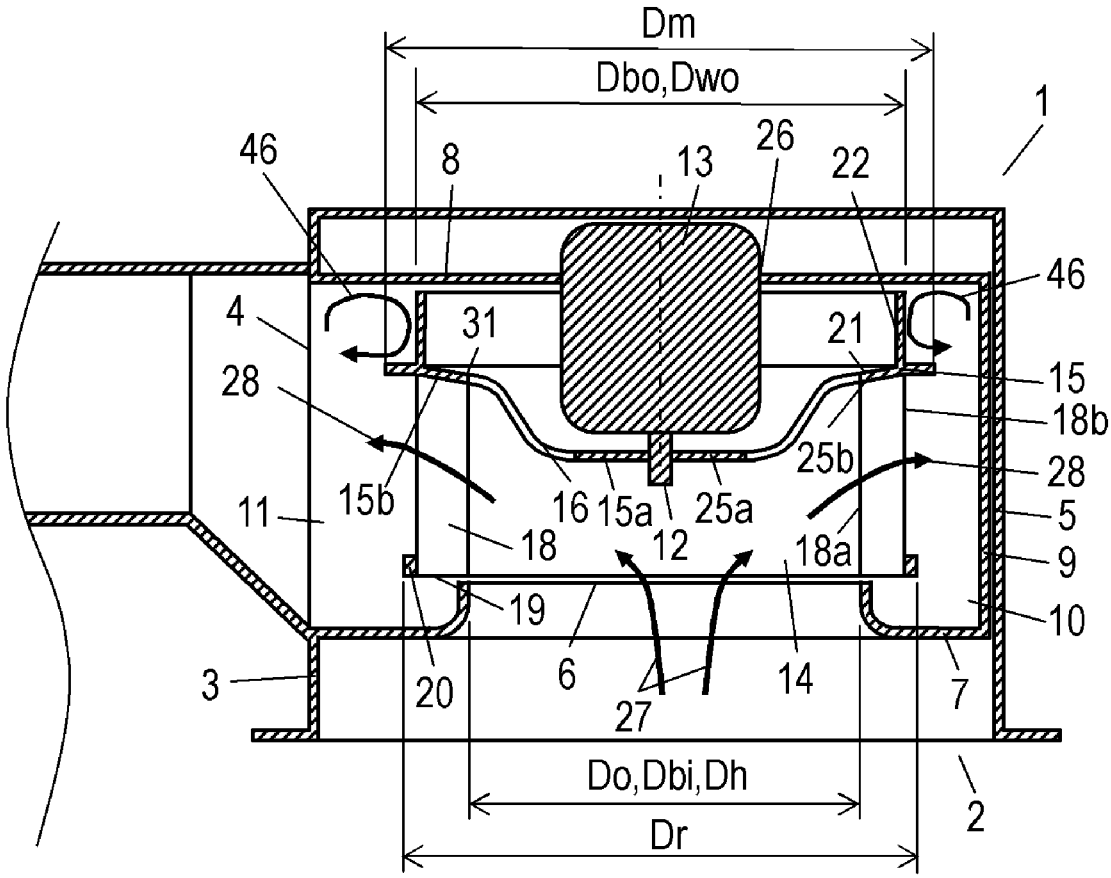
FIG. 13 is a side sectional view showing a centrifugal impeller and a centrifugal air blower in accordance with an eleventh exemplary embodiment of the present invention.
Figure 14:
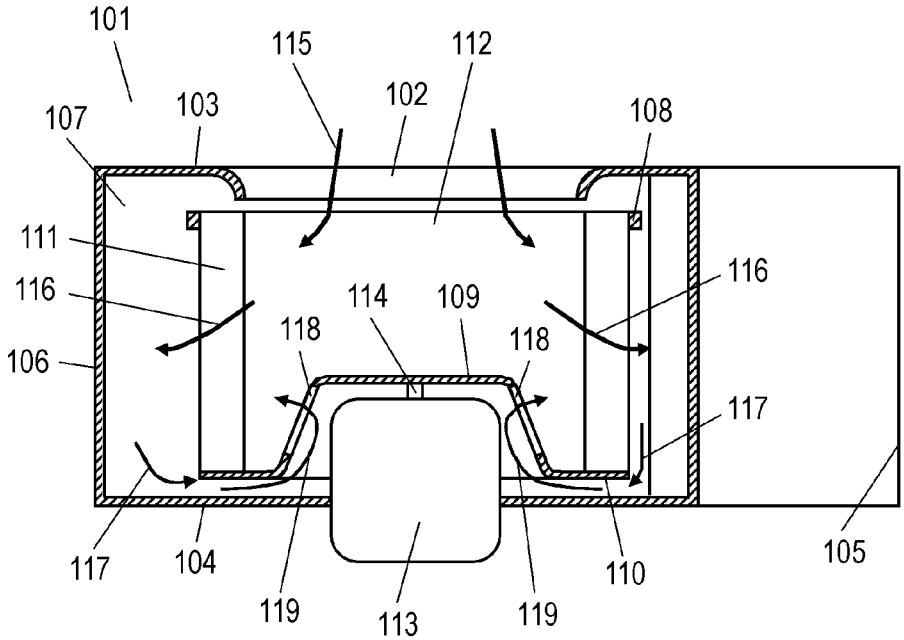
FIG. 14 is a side sectional view showing a conventional structure of a centrifugal impeller and a centrifugal air blower.
Figure 15:
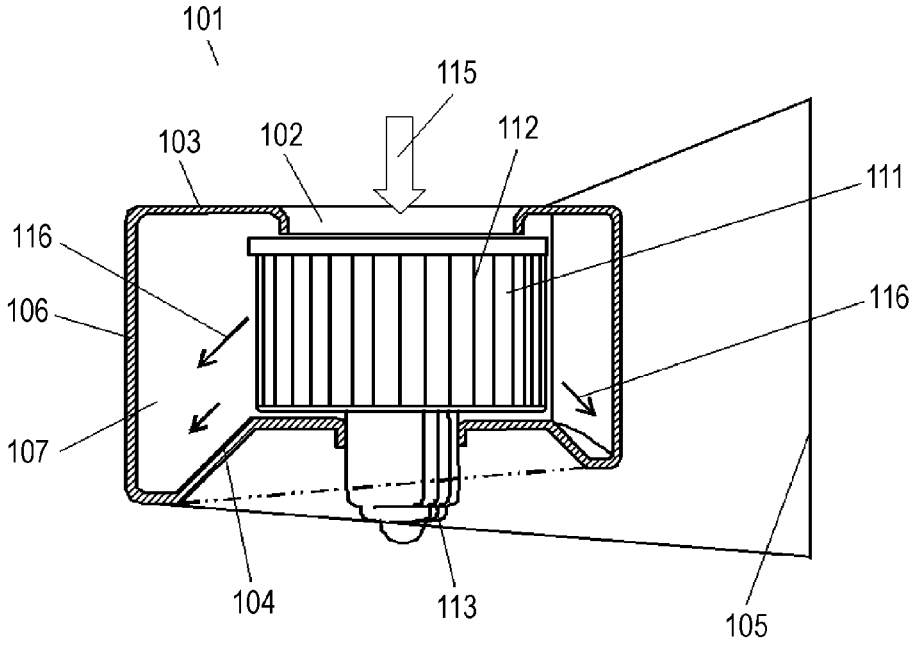
FIG. 15 is a side sectional view showing another structure of a conventional air blower.

FIG. 13 shows centrifugal impeller 14 and centrifugal air blower 1 in accordance with the eleventh exemplary embodiment of the present invention. In the drawing, the same reference marks are used as in the structure described in the first through the tenth embodiments for similar parts and in-detail explanations thereof will be omitted. According to centrifugal air blower 1 of the embodiment, as shown in FIG. 13, main plate 15 has outer diameter Dm of 200 mm, blades 18 has blade outer-diameter Dbo of 182 mm, and cylindrical wall 22 has outer diameter Dwo of 182 mm. That is, air blower 1 has a structure that satisfies the following equation: Dm>Dbo=Dwo.

The structure allows flow 28 from blades 18 to have a gradually increasing area of the channel until the flow reaches the outer periphery of main plate 15, decreasing the speed of the air flow. That is, the structure suppresses enlargement loss caused by a sudden increase in flow. At the same time, the structure suppresses collision between flow 28 from blades 18 and strong swirl flow 46 that occurs around cylindrical wall 22 due to the helical shape of side wall 9 of casing 10. The structure above improves air-blow efficiency and decreases noise of air blower 1 and impeller 14.

INDUSTRIAL APPLICABILITY

The centrifugal impeller and a centrifugal air blower of the present invention offer high efficiency of air blow and low-noise operations. At the same time, the size-reduced, simplified structure contributes to cost-reduced production. The centrifugal impeller and the centrifugal air blower are therefore suitable for ventilating fans and air-conditioning devices.

The invention claimed is:

1. A centrifugal impeller comprising:
a disc-shaped main plate;
a plurality of blades circumferentially disposed on a side of an outer periphery of a front side of the main plate;
a ring-shaped plate attached to tip sections of the blades; and
a cylindrical wall disposed on a back side of the main plate so as to be concentric with the main plate, wherein height of the cylindrical wall is within a range of at least 30% and at most 40% of height of the blades.

2. The centrifugal impeller of claim 1, wherein the main plate has a ventilation hole so that air passes through the main plate.

3. The centrifugal impeller of claim 2, wherein an inner diameter of the blades is equal to an outer diameter of the ventilation hole.

4. The centrifugal impeller of claim 2, wherein the cylindrical wall has an inner cylindrical wall and an outer cylindrical wall which are different in outer diameter.

5. The centrifugal impeller of claim 4, wherein an inner diameter of the inner cylindrical wall is equal to an outer diameter of the ventilation hole.

6. The centrifugal impeller of claim 2, wherein the main plate has a cone-shaped projection inside the blades.

7. The centrifugal impeller of claim 1, wherein the plurality of blades are formed into a multi-blade impeller.

8. The centrifugal impeller of claim 1, wherein an outer diameter of the blades is equal to an outer diameter of the cylindrical wall.

9. The centrifugal impeller of claim 1, wherein the cylindrical wall is formed of a sound-absorbing material.

10. The centrifugal impeller of claim 1, wherein a joint section of the main plate and the blades inclines to the cylindrical wall as the joint section extends in a radially-outward direction.

11. The centrifugal impeller of claim 1, wherein the cylindrical wall has an outer diameter that gradually increases toward an edge of the cylindrical wall.

12. The centrifugal impeller of claim 1, wherein a drain hole is disposed in any one of the cylindrical wall and the main plate.

13. The centrifugal impeller of claim 1, wherein a weight for keeping balance is disposed inside the cylindrical wall.

14. A centrifugal air blower comprising:
a centrifugal impeller including:
a disc-shaped main plate;
a plurality of blades circumferentially disposed on a side of an outer periphery of a front side of the main plate;
a ring-shaped plate attached to tip sections of the blades; and
a cylindrical wall disposed on a back side of the main plate so as to be concentric with the main plate
an electric motor having a rotary shaft fixed to the centrifugal impeller; and
a casing for accommodating the electric motor, the casing further including:
an air-intake plate having a bell-mouthed air inlet;
a back plate facing the air-intake plate;
a spiral-shaped side wall;
an air outlet; and
a helical section disposed outside the centrifugal impeller on the back plate so that height of the casing gradually increases from around a tongue section toward the air outlet,
wherein, the main plate is fixed to the rotary shaft in the casing.

15. The centrifugal air blower of claim 14, wherein a distance between an area outside the centrifugal impeller in the back plate and the air inlet is greater than a distance between the main plate and the air inlet.

16. The centrifugal air blower of claim 15, wherein the back plate is a flat plate.

17. The centrifugal air blower of claim 14, wherein the helical section has an axial position so as to be identical with the main plate in a periphery of the tongue section and so as to be identical with the cylindrical wall in a periphery of the air outlet.

18. The centrifugal air blower of claim 14, wherein the helical section is formed as an individual part separated from the back plate.

19. The centrifugal air blower of claim 14, wherein the centrifugal impeller in which the main plate has a ventilation hole is disposed inside the casing.

20. The centrifugal air blower of claim 14, wherein the back plate has a back-plate projection that protrudes outside the casing, and the back plate and the main plate are positioned axially identical with respect to the rotary shaft.

21. The centrifugal air blower of claim 14, wherein at least a part of the electric motor is disposed inside the cylindrical wall.

22. A centrifugal air blower comprising:
a centrifugal impeller including:
a disc-shaped main plate;
a plurality of blades circumferentially disposed on a side of an outer periphery of a front side of the main plate;
a ring-shaped plate attached to tip sections of the blades; and
a cylindrical wall disposed on a back side of the main plate so as to be concentric with the main plate;
an electric motor having a rotary shaft fixed to the centrifugal impeller; and
a casing for accommodating the electric motor, the casing further including:
an air-intake plate having a bell-mouthed air inlet;
a back plate facing the air-intake plate;
a spiral-shaped side wall; and
an air outlet
wherein the main plate has an outer diameter not only greater than an outer diameter of the blades but also greater than an outer diameter of the cylindrical wall.

23. A centrifugal impeller comprising:

a disc-shaped main plate;

a plurality of blades circumferentially disposed on a side of an outer periphery of a front side of the main plate;

a ring-shaped plate attached to tip sections of the blades; and a cylindrical wall disposed on a back side of the main plate so as to be concentric with the main plate, wherein the cylindrical wall is formed of a sound-absorbing material.

* * * * *